US005937779A

United States Patent [19]

Murnikov

[11] Patent Number: 5,937,779

[45] Date of Patent: Aug. 17, 1999

[54] SINGLE-HAND SAILBOAT HAVING NOVEL SPINNAKER RAISING AND LOWERING SYSTEM

[75] Inventor: Vlad Murnikov, Sudbury, Mass.

[73] Assignee: M-Yachts, Inc., Sudbury, Mass.

[21] Appl. No.: 08/950,129

[22] Filed: Oct. 14, 1997

Related U.S. Application Data

[60] Provisional application No. 60/028,408, Oct. 15, 1996.

[51] Int. Cl.[6] ..... B63H 9/10

[52] U.S. Cl. ..... 114/104; 114/39.001

[58] Field of Search ..... 114/39.1, 102–105, 114/111

[56] References Cited

U.S. PATENT DOCUMENTS

| | | | |
|---|---|---|---|
| 3,310,018 | 3/1967 | Roberts, Jr. et al. | 114/104 |
| 4,102,289 | 7/1978 | Ebbeson et al. | 114/104 |
| 4,262,617 | 4/1981 | Svensson | 114/104 |
| 5,636,584 | 6/1997 | Walker | 114/104 |

*Primary Examiner*—Ed L. Swinehart
*Attorney, Agent, or Firm*—George L. Boller

[57] ABSTRACT

A spinnaker raising and lowering system is provided for a sailboat. The system includes a first pulley mounted in a movable mounting. A second pulley contained in a mounting which is fixed to the deck of the sailboat. A third pulley contained in a mounting that is disposed in a fixed relation to the mast of the sailboat, and is fixed above the deck, and a fourth pulley contained in a mounting that is disposed in fixed relation to the first pulley. A first rope attached to the top of the spinnaker extends around the third pulley, first pulley, second pulley and then is attached to the mounting of the first pulley. A second rope attached to the bottom of the spinnaker extends forwardly around the fourth pulley and then to the mounting of the first pulley. A third rope attached to the leading edge of the spinnaker intermediate the attachment points of the first and second ropes extends aft through a spinnaker sleeve.

6 Claims, 3 Drawing Sheets

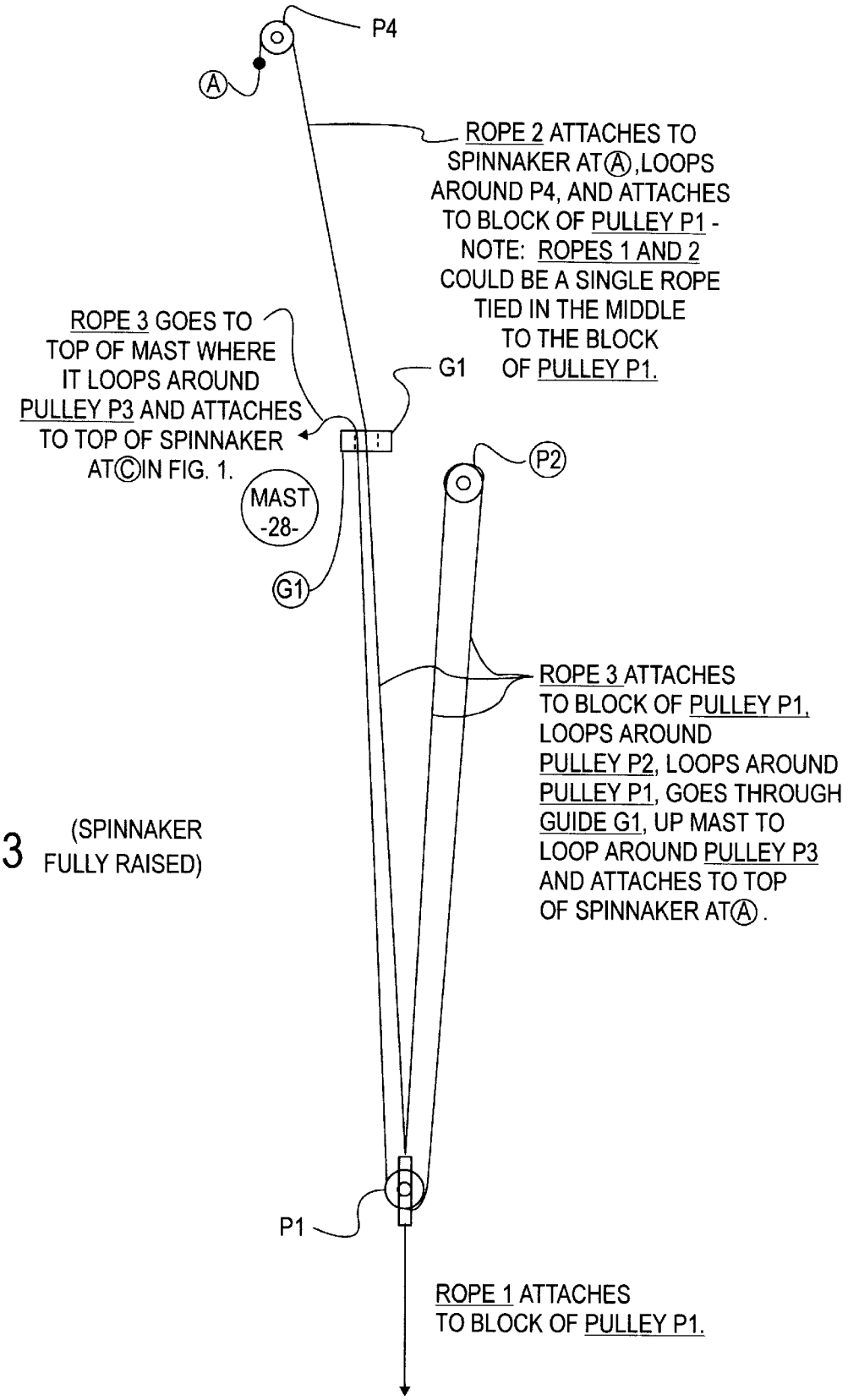
FIG. 3 (SPINNAKER FULLY RAISED)

SINGLE-HAND SAILBOAT HAVING NOVEL SPINNAKER RAISING AND LOWERING SYSTEM

PRIORITY CLAIM

I hereby claim the priority of my provisional patent application of the same title filed as Ser. No. 60/028,408, on Oct. 15, 1996.

FIELD OF THE INVENTION

This invention relates to sailboats, and particularly to a novel spinnaker raising and lowering system that is especially advantageous for a single-hand sailboat.

BACKGROUND AND SUMMARY OF THE INVENTION

Certain sailboats are designed with a view toward performance, meaning speed, and such sailboats may at times compete in racing events. One factor in designing a speedy sailboat involves the shape and construction of the hull and deck. An objective that may be sought in design of a performance craft is to minimize its resistance to forward motion in the water. Another objective, which is especially important in the case of a single-hand sailboat, is to facilitate the hand's raising and lowering, and setting, of the craft's sails.

The present invention relates to a novel system for raising and lowering a spinnaker sail of a single-hand sailboat. Still another aspect relates to the layout of sail controls to facilitate setting of the controls by the hand.

The foregoing, along with additional features, and other advantages and benefits of the invention, will be seen in the ensuing description which is accompanied by drawings. The drawings disclose a preferred embodiment of the invention according to the best mode contemplated at this time for carrying out the invention.

BRIEF DESCRIPTION OF THE DRAWINGS

FIG. 3 is a diagram of the spinnaker sail system showing relationship of various components with the spinnaker sail fully raised.

DESCRIPTION OF THE PREFERRED EMBODIMENT

Figure 1:
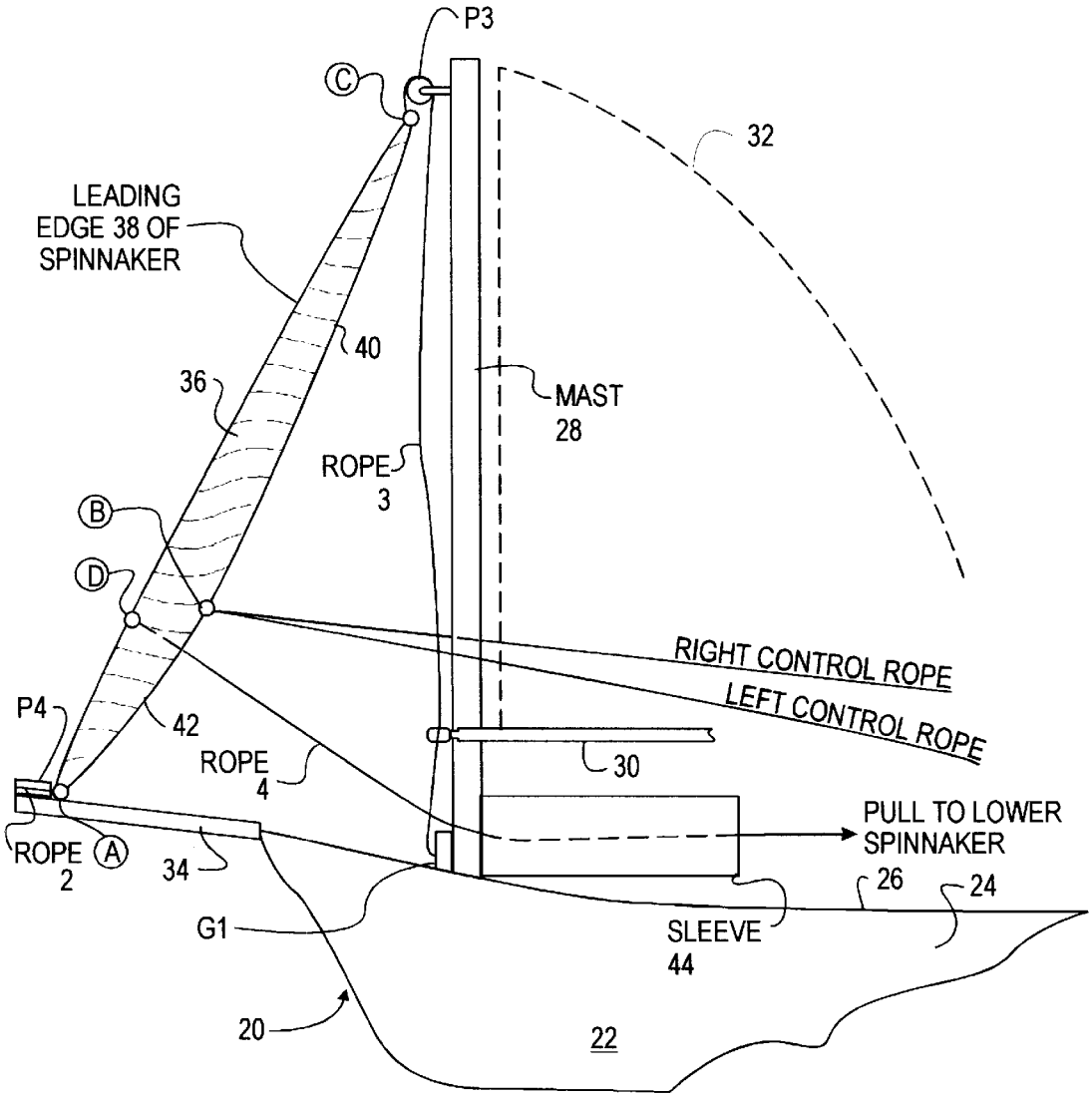
FIG. 1 is a left side elevation view of a bow portion of a sailboat showing a spinnaker sail in fully raised position.
Figure 2:
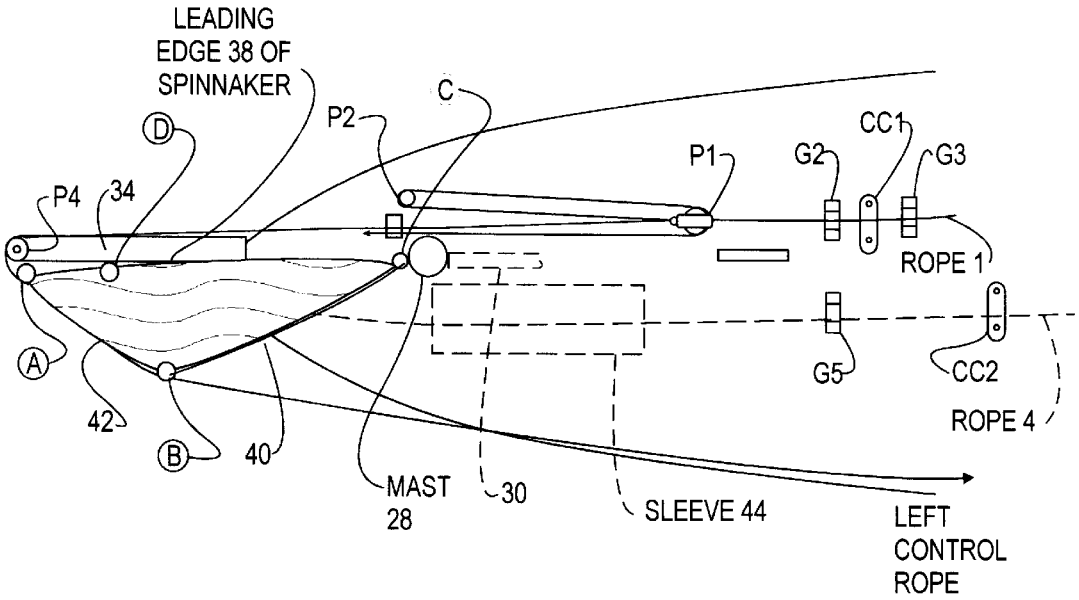
FIG. 2 is a top plan view of FIG. 1.

FIGS. 1 and 2 show a sailboat 20 embodying principles of the invention. Sailboat 20 comprises a hull 22 composed of a one-piece hull member 24 and a one-piece deck member 26 joined together around their outer margins. Hull 22 comprises a mounting for a mast 28. A boom 30 is connected to mast 28 by a conventional fitting, and two sides of a mainsail 32 are supported along the boom and the mast respectively when the main sail is fully raised. Controls for raising, lowering and setting the mainsail will be described later. One end of a bowsprit 34 is mounted in a socket formed at the fore end of deck member 26, with the bowsprit extending a distance fore from the bow.

A spinnaker sail 36 is shown fully raised in FIGS. 1 and 2 and set to the port side. The spinnaker sail is somewhat triangular in shape and may be considered to have three edges: a leading edge 38, a back edge 40, and a bottom edge 42. Leading edge 38 and bottom edge 42 meet at a corner A; bottom edge 42 and back edge 40 meet at a corner B; and back edge 40 and leading edge 38 meet at a corner C. For convenience in describing the system for raising and lowering the spinnaker sail, reference will be made to certain ropes and items of hardware.

The system comprises a pulley, or sheave, P3 mounted proximate the top of mast 28. One end of Rope 3 (a halyard for raising the spinnaker) attaches to corner C, and from there Rope 3 is guided by pulley P3 downward along mast 28 to pass through a guide G1 mounted on the deck. From guide G1, Rope 3 extends aft to loop around a pulley P1 for generally reversing the direction of Rope 3 so that Rope 3 can run forward to loop around a pulley P2 whose frame is mounted on the deck. Pulley P2 reverses the direction of Rope 3 so that Rope 3 continues aft where its other end attaches to the block or frame of pulley P1.

One end of another rope, Rope 2 (a deck line), attaches to corner A. From there, Rope 2 is guided by pulley P4, mounted on the fore end of bowsprit 34, to run generally aft, passing through guide G1. The other end of Rope 2 attaches to the block, or frame, of pulley P1.

Rope 1 provides for raising the spinnaker while a Rope 4 provides a lowering halyard for lowering the spinnaker. One end of Rope 1 is attached to the frame of pulley P1 and from there it extends to be accessible to the hand sailing the craft. One end of Rope 4 is attached to the spinnaker at point D which lies along the leading edge of the spinnaker between corners A and C, being nearer to corner A. From there Rope 4 extends through the interior of a fabric sleeve 44, and aft from there to be accessible to the hand sailing the craft. Sleeve 44 is fastened to the deck to one side of the mast, as shown, so that its length runs generally fore and aft. The interior of sleeve 44 provides a storage space for storing the spinnaker when the spinnaker is lowered and stored away.

Two additional ropes called a right, or starboard, control rope (or sheet line) and a left, or port, control rope (or sheet line) extend from corner B, one on either side of the mast, to set the spinnaker to starboard or port once it has been fully raised.

As shown in FIG. 2, Rope 1 passes through a guide G2, then a cam cleat CC1, and then a guide G3, upon leaving pulley P1. Rope 4 passes through a guide G5 and a cam cleat CC2 after leaving sleeve 44.

FIGS. 1–3 show the spinnaker fully raised. To lower the spinnaker, the hand pulls on Rope 4. This begins pulling the leading edge 38 toward the fore entrance of sleeve 44. This pull on the spinnaker also will begin to act through the spinnaker itself to pull on the end of Rope 2 that is attached to the spinnaker. Since the other end of Rope 2 is attached to the frame of pulley P1, pulley P1 is pulled to the fore. Such displacement of pulley P1 allows Rope 3 to begin to slacken, and such slackening allows corner C to be pulled downward by the action of Rope 4 acting through the spinnaker. Continued pulling of Rope 4 pulls D into sleeve 44 and the rest of the spinnaker follows as the rope continues to be pulled. The spinnaker is now stored in the sleeve.

Raising of the spinnaker occurs by pulling on Rope 1. This pulls pulley P1 aft, and Rope 2 will be pulled to pull on corner A of the spinnaker. The same pulling on Rope 1 also pulls on Rope 3 which in turn pulls on corner C of the spinnaker. The pulls on corners A and C begins to extract the spinnaker from the sleeve, with corner A traveling fore toward the fore end of bowsprit 34 and corner C traveling up mast 28. Continued pulling on Rope 1 extracts the spinnaker fully from the sleeve and fully raises the spinnaker to the position shown by FIGS. 1 and 2. Rope 1 and Rope 2 can be a single length of line that is tied to the frame of pulley P1.

While a presently preferred embodiment of the invention has been illustrated and described, it should be appreciated that principles of the invention apply to all embodiments falling within the scope of the following claims.

What is claimed is:

1. A spinnaker raising and lowering system for a boat having a deck, a mast that extends uprightly from the deck, and a spinnaker sail that is disposed generally fore of the mast when deployed and that has a leading edge, the system comprising:

lines for deploying and stowing the spinnaker comprising: a first line that is pulled aft to deploy the spinnaker, a purchase that is operated by the first line and that has two spaced apart points of operative connection to the spinnaker for causing the spinnaker to be hoisted via one of the two points of operative connection and pulled to fore via the other of the two points of operative connection as the first line is being pulled aft; and a second line that is pulled aft to stow the spinnaker.

2. A spinnaker raising and lowering system as set forth in claim 1 including a spinnaker storage sleeve, the second line passing through the spinnaker storage sleeve.

3. A spinnaker raising and lowering system as set forth in claim 1 in which the spinnaker has a leading edge, the first line operatively connects to the purchase, the two points of operative connection of the purchase to the spinnaker being spaced apart along the leading edge, and the second line having a point of operative connection to the spinnaker that is along the leading edge between the two points of operative connection of the purchase to the spinnaker.

4. A single-hand sailboat comprising:

a hull having a deck; a mast extending uprightly from the deck; a mainsail that is supported by the mast; a spinnaker sail that is disposed generally fore of the mast when deployed; and a spinnaker raising and lowering system comprising lines for raising and lowering the spinnaker on the mast comprising a first line that is pulled aft to raise the spinnaker, a purchase that is operated by the first line and that has two spaced apart points of operative connection to the spinnaker for causing the spinnaker to be hoisted via one of the two points of operative connection and pulled to fore via the other of the two points of operative connection as the first line is being pulled aft; and a second line that is pulled aft to lower the spinnaker.

5. A spinnaker raising and lowering system as set forth in claim 4 including a spinnaker storage sleeve disposed on the deck, the second line passing through the spinnaker storage sleeve.

6. A spinnaker raising and lowering system as set forth in claim 4 in which the spinnaker has a leading edge, the two points of operative connection of the purchase to the spinnaker being spaced apart along the leading edge and the second line having a point of operative connection to the spinnaker that is along the leading edge between the two points of operative connection of the purchase to the spinnaker.

* * * * *